US010125645B2

(12) United States Patent
Morishita et al.

(10) Patent No.: US 10,125,645 B2
(45) Date of Patent: Nov. 13, 2018

(54) OIL SEPARATOR

(71) Applicant: TOYOTA BOSHOKU KABUSHIKI KAISHA, Aichi-ken (JP)

(72) Inventors: Hideto Morishita, Gifu (JP); Yoji Horiuchi, Kariya (JP); Naritsune Miyanaga, Toyota (JP); Naoki Takeuchi, Toyota (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 74 days.

(21) Appl. No.: 15/264,022

(22) Filed: Sep. 13, 2016

(65) Prior Publication Data

US 2017/0081998 A1 Mar. 23, 2017

(30) Foreign Application Priority Data

Sep. 17, 2015 (JP) ..... 2015-184044

(51) Int. Cl.
*F01M 13/04* (2006.01)

(52) U.S. Cl.
CPC ..... *F01M 13/04* (2013.01); *F01M 2013/0438* (2013.01); *F01M 2013/0466* (2013.01)

(58) Field of Classification Search
CPC ..... F01M 13/04; F01M 2013/0438; F01M 2013/0466
See application file for complete search history.

(56) References Cited

U.S. PATENT DOCUMENTS 5,332,485 A * 7/1994 Thompson ..... B01D 35/06 204/665

FOREIGN PATENT DOCUMENTS

JP 3-141811 6/1991
JP 2009008096 A * 1/2009 ..... B03C 3/06

* cited by examiner

*Primary Examiner* — Jacob Amick
*Assistant Examiner* — Charles Brauch
(74) *Attorney, Agent, or Firm* — Greenblum & Bernstein, P.L.C.

(57) ABSTRACT

An oil separator includes a case, electrode plates, filters, and a power supply unit. The electrode plates are arranged in the case with a space in between such that any two adjacent electrode plates face each other. The filters are made of an electrically insulating material and each arranged between any two adjacent electrode plates. The power supply unit is connected to the electrode plates and applies voltage between any two adjacent electrode plates, thereby creating a potential difference between the adjacent electrode plates. The filling factor of each filter is in a range from 0.005 to 0.03. The voltage applied between any two adjacent electrode plates by the power supply unit is in a range from 0.5 to 5 kV. The distance between any two adjacent electrode plates is in a range from 3 to 20 mm.

4 Claims, 4 Drawing Sheets

OIL SEPARATOR

BACKGROUND OF THE INVENTION

The present invention relates to an oil separator having a case that introduces blow-by gas of an internal combustion engine into the case, separates oil from the blow-by gas, and discharges the separated oil from the case.

Internal combustion engines are equipped with a recirculation passage for recirculating blow-by gas in the crank chamber to the intake passage. An oil separator is provided in such a recirculation passage to separate oil mist from the blow-by gas (for example, Japanese Laid-Open Patent Publication No. 3-141811).

The case of the oil separator disclosed in the above publication incorporates two meshed first and second electrodes, which are arranged to face each other. A power supply unit creates a potential difference between the first and second electrodes. In the oil separator, water contained in blow-by gas is electrically charged when the blow-by gas passes through the first electrode, and the electrically charged water is adsorbed to the second electrode due to electrostatic force. At this time, oil mist contained in the blow-by gas is adsorbed to the second electrode together with the water. Oil mist contained in the blow-by gas is thus separated from the blow-by gas in this manner. The oil and water adsorbed to the second electrode drop due to the own weight and are drained from the case through an oil drain port formed in the bottom wall of the case.

In the oil separator disclosed in Japanese Laid-Open Patent Publication No. 3-141811, when the flow velocity of blow-by gas is great, oil is likely to flow through the second electrode without being adsorbed to the second electrode. The oil trapping efficiency is thus low.

In this respect, the mesh of the second electrode may be made finer so that oil is easily adsorbed to the second electrode. In this case, however, the finer mesh of the second electrode increases the airflow resistance, causing another problem. That is, the pressure loss by the oil separator increases.

SUMMARY OF THE INVENTION

Accordingly, it is an objective of the present invention to provide an oil separator that reliably improves the oil trapping efficiency.

To achieve the foregoing objective and in accordance with one aspect of the present invention, an oil separator including a case is provided. The oil separator is configured to introduce blow-by gas of an internal combustion engine into the case, separate oil from the blow-by gas, and discharge the separated oil from the case. The oil separator includes a plurality of electrode plates, which are arranged in the case such that two adjacent electrode plates face each other with a space therebetween, a filter, which is made of an electrically insulating material and arranged between the adjacent electrode plates, and a power supply unit, which is connected to the electrode plates and applies voltage between the adjacent electrode plates, thereby creating a potential difference between the adjacent electrode plates. A filling factor of the filter is in a range from 0.005 to 0.03. The voltage applied between the adjacent electrode plates by the power supply unit is in a range from 0.5 to 5 kV. A distance between the adjacent electrode plates is in a range from 3 to 20 mm.

DETAILED DESCRIPTION OF THE PREFERRED EMBODIMENTS

An oil separator according to one embodiment will now be described with reference to FIGS. 1 to 8.

Figure 1:
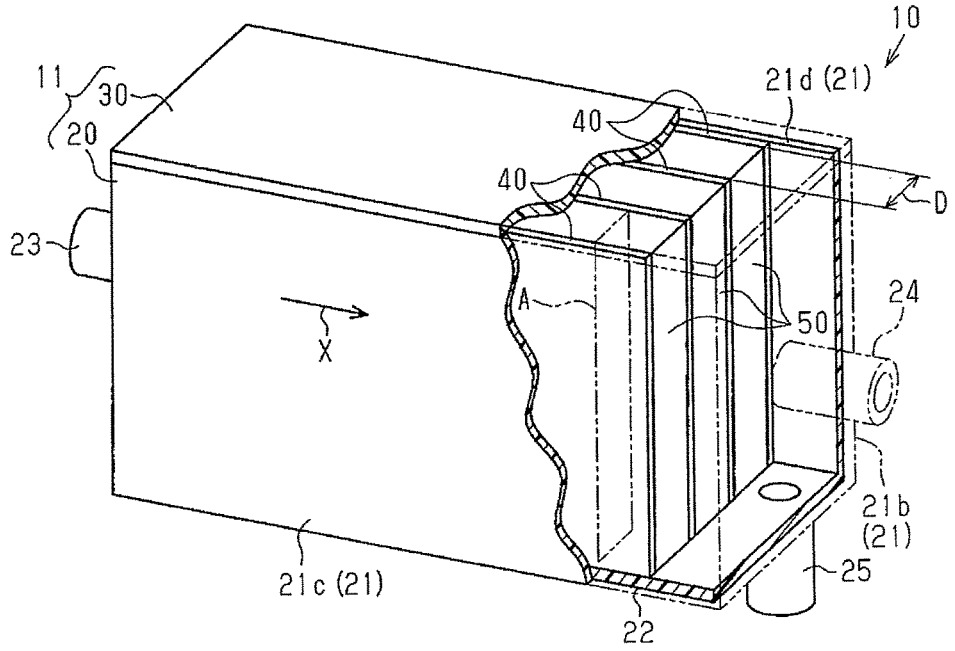
FIG. 1 is a perspective view of an oil separator according to one embodiment.

An oil separator 10 shown in FIG. 1 is arranged in a recirculation passage, which recirculates blow-by gas in the crank chamber of an internal combustion engine to the intake passage. The oil separator 10 includes a case 11, which is made of an electrically insulating hard plastic such as nylon 66.

The case 11 includes a case body 20 with an upper opening and a lid 30, which selectively opens and closes the upper opening of the case body 20. The case body 20 includes a bottom wall 22, which is rectangular when viewed from above, and side wall 21 extending from the four sides of the bottom wall 22.

Figure 2:
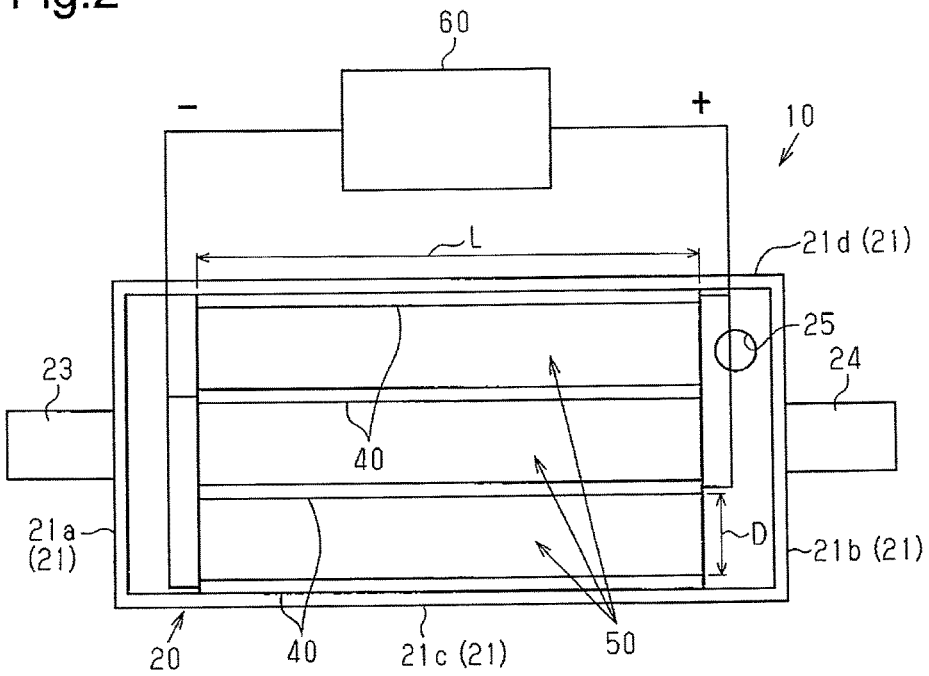
FIG. 2 is a plan view of the oil separator shown in FIG. 1 with the lid removed.

Specifically, as shown in FIGS. 1 and 2, the side wall 21 includes first and second side wall portions 21*a*, 21*b*, which extend upward from the short sides of the bottom wall 22, and third and fourth side wall portions 21*c*, 21*d*, which extend upward from the long sides of the bottom wall 22. The first side wall portion 21*a* is located at a first end in the longitudinal direction of the case body 20. A cylindrical gas inlet 23 projects outward from the first side wall portion 21*a*. The second side wall portion 21*b* is located at a second end in the longitudinal direction of the case body 20. A cylindrical gas outlet 24 projects outward from the second side wall portion 21*b*. An oil drain port 25 projects downward from a part of the bottom wall 22 that is close to the gas outlet 24.

The case body 20 incorporates four electrode plates 40 made of stainless steel. The electrode plates 40 are arranged to extend vertically and in the longitudinal direction, which agrees with the blow-by gas flowing direction. The electrode plates 40 are arranged to face each other at intervals. Any two adjacent electrode plates 40 are arranged to be parallel with each other. The distance D between any two adjacent electrode plates 40 is preferably set in the range from 3 to 20 mm, and more preferably 5 to 15 mm. For example, the distance D between any two adjacent electrode plates 40 is set to 10 mm. The electrode plates 40 are separated from the first side wall portion 21*a* and the second side wall portion 21*b*, which are located at the first end and the second end in the longitudinal direction. The number of the electrode plates 40 may be changed to any number greater than one.

As shown in FIG. 2, a power supply unit 60 is connected to the electrode plates 40 via conducting wires. The odd-numbered electrode plates 40 from the top in FIG. 2 are connected to the positive terminal (+) of the power supply unit 60, while the even-numbered electrode plates 40 from the top in FIG. 2 are connected to the negative terminal (−) of the power supply unit 60 or grounded. Thus, the power supply unit 60 creates a predetermined potential difference between any two adjacent electrode plates 40. The voltage applied between any two adjacent electrode plates 40 is preferably set in the range from 0.5 to 5 kV, and more preferably 3 to 5 kV. For example, the voltage applied between any two adjacent electrode plates 40 is set to 5 kV. In FIG. 1, the power supply unit 60 is omitted.

A filter 50 made of fibers 51 (refer to FIG. 3) is arranged between any two adjacent electrode plates 40. The fibers 51 are made of an electrically insulating material, which is polyester. Electrically insulating materials such as polyester are dielectric materials, in which dielectric polarization occurs. Each filter 50 is held in contact with the two adjacent electrode plates 40. That is, the thickness of each filter 50 is equal to the distance D between the two adjacent electrode plates 40. The vertical dimension and the longitudinal dimension of the filters 50 are set to be the same as the vertical dimension and the longitudinal dimension of the electrode plates 40, respectively. The position of the filters 50 in the longitudinal direction corresponds to the position of the electrode plates 40 in the longitudinal direction. Substantially no electricity flows through the filters 50, which are made of an electrical insulating material. This restricts any two adjacent electrode plates 40 from being electrically connected to each other via the water trapped by the filters 50.

The filling factor of each filter 50 is preferably in the range from 0.005 to 0.03, and more preferably in the range from 0.01 to 0.02. The filling factor of the filter 50 refers to the ratio of the volume of the fibers 51 to the volume of the filter 50 including the spaces among the fibers 51. Further, as shown in FIG. 1, the length L of each filter 50 in the blow-by gas flowing direction (refer to arrow X in FIG. 1) is preferably less than or equal to 200 mm, and more preferably less than or equal to 100 mm. In the present embodiment, the blow-by gas flowing direction agrees with the longitudinal direction of the filters 50. The area A of the cross-section of each filter 50 perpendicular to the blow-by gas flowing direction is preferably set to a value at which the flow velocity of blow-by gas passing through the filter 50 is less than or equal to 0.9 m/s. The flow velocity of blow-by gas is calculated by dividing the flow rate of blow-by gas passing through the oil separator 10 per unit time by the sum of the areas A of the cross-sections of the three filters 50 perpendicular to the blow-by gas flowing direction.

Operation of the present embodiment will now be described.

Blow-by gas that has been introduced into the case 11 through the gas inlet 23 moves toward the gas outlet 24.

Figure 3:
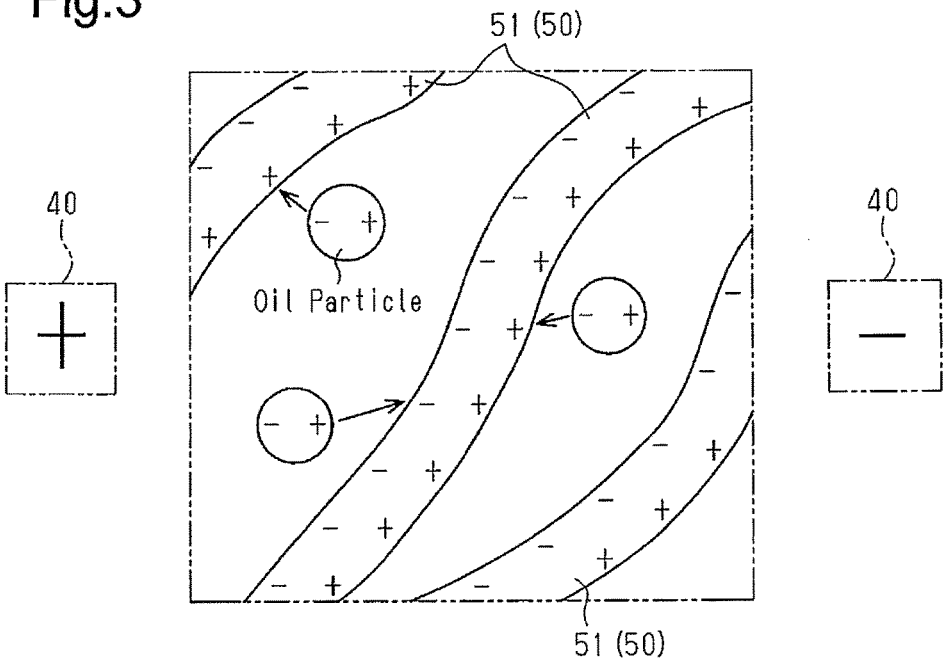
FIG. 3 is an explanatory diagram showing operation of the oil separator of FIG. 1.

In the oil separator 10, a filter 50 is arranged between any two adjacent electrode plates 40. Thus, a potential difference between any two adjacent electrode plates 40 generates an electrostatic field between the electrode plates 40 as shown in FIG. 3, and a positive (+) or negative (−) electric charge is generated on the surfaces of the fibers 51 of the filter 50 due to dielectric polarization. As a result, when electrically charged oil particles in the oil mist contained in the blow-by gas pass through between the adjacent electrode plates 40, the moving direction is bent by the electrostatic force, and the oil particles are trapped by the filter 50.

Also, when non-charged oil particles in the oil mist contained in the blow-by gas pass through the clearances between the fibers 51 of the filter 50 as shown in FIG. 3, the surfaces of the oil particles are positively charged (+) or negatively charged (−) due to dielectric polarization. Thus, the oil particles are drawn to the negative charge (−) or the positive charge (+) on the surfaces of the fibers 51 of the filter 50 due to electrostatic force and trapped by the filter 50.

In this manner, the oil separator 10 of the present embodiment allows the filter 50 with coarse mesh to effectively trap oil contained in blow-by gas. This restricts the filter 50 from increasing the airflow resistance. Therefore, the configuration increases the oil trapping efficiency, while limiting increase in the pressure loss.

The blow-by gas, from which oil has been separated, flows out to the blow-by gas recirculation passage through the gas outlet 24. The oil, which has been separated from the blow-by gas and collected on the bottom wall 22, moves along the bottom wall 22 and is then discharged from the case 11 through the oil drain port 25.

If the filling factor of the filters 50 is excessively high, the trapped oil clogs the filters 50, increasing the pressure loss. In contrast, if the filling factor of the filters 50 is excessively low, the oil trapping performance is lowered. If the voltage applied between any two adjacent electrode plates 40 is excessively low, the oil trapping performance is lowered. In contrast, if the voltage applied between any two adjacent electrode plates 40 is excessively high, the two electrode plates are electrically connected to each other, increasing the power consumption. If the distance D between any two adjacent electrode plates 40 is excessively long, dielectric polarization is unlikely to occur on the surfaces of the filter 50, that is, the surfaces of the fibers 51 in the filter 50, lowering the trapping performance. In contrast, if the distance D between any two adjacent electrode plates 40 is excessively short, the two electrode plates 40 are electrically connected to each other, increasing the power consumption. If the length L of the filter 50 is too long or the cross-sectional area A of the filter 50 is too great, the size of the oil separator 10 is increased, making it difficult for the oil separator 10 to be installed in a limited mounting space in the vehicle. In contrast, if the length of the filter 50 is too short or the cross-sectional area A of the filter 50 is too small, the oil trapping performance is lowered.

In this regard, experiments were conducted to derive the relationship between the oil trapping efficiency and the filling factor of the filters 50, the relationship between the oil trapping efficiency and the voltage applied between any two adjacent electrode plates 40, the relationship between the oil trapping efficiency and the distance D between any two adjacent electrode plates 40, the relationship between the oil trapping efficiency and the length L of the filters 50 in the blow-by gas flowing direction, and the relationship between the oil trapping efficiency and the flow velocity of the blow-by gas flowing through the filters 50.

Figure 4:
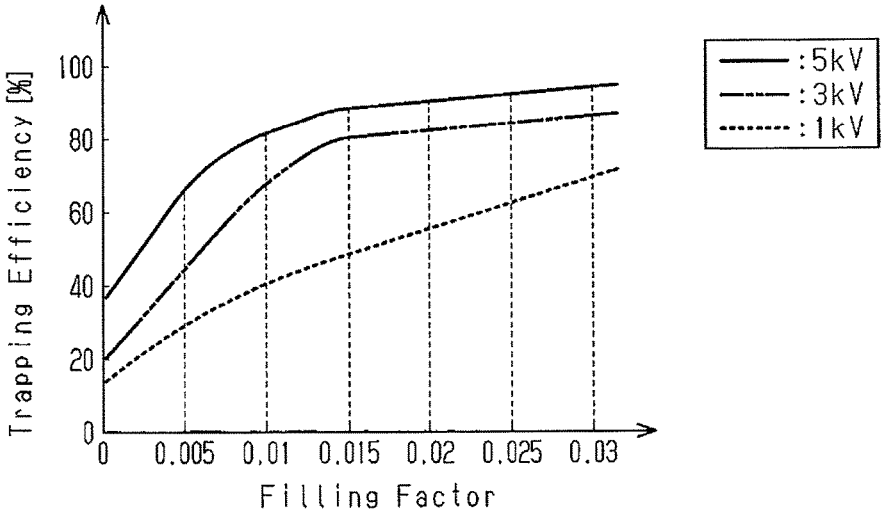
FIG. 4 is a graph showing the relationship between the filling factor of the filters and the oil trapping efficiency.

FIG. 4 is a graph showing the relationship between the filling factor of the filters 50 and the oil trapping efficiency. In the experiment for deriving the relationship between the filling factor of the filters 50 and the oil trapping efficiency, the filling factor of the filters 50 was changed in each of the cases in which the voltage applied between any two adjacent electrode plates 40 was set to 1 kV, 3 kV, and 5 kV, and the oil trapping efficiency was measured in each case. In the experiments, the distance D between any two adjacent electrode plates 40 was set to 10 mm, the length L of the filters 50 was set to 100 mm, and the cross-sectional area A of each filter 50 was set to 0.0015 $m^2$. The flow velocity of the blow-by gas was set to 1.1 m/s. FIG. 4 shows the relationship between the filling factor of the filters 50 and the oil trapping efficiency in each of the cases in which the voltage applied between any two adjacent electrode plates 40 was set to 1 kV, 3 kV, and 5 kV.

As shown in FIG. 4, the higher the filling factor of the filters 50, the higher the oil trapping efficiency becomes. In the case in which the voltage is higher than or equal to 3 kV, the rate of increase in the trapping efficiency diminishes when the filling factor of the filters 50 exceeds 0.015. In general, the higher the filling factor of the filter 50, the greater the pressure loss becomes. Therefore, setting the filling factor of each filter 50 in the range from 0.005 to 0.03 increases the oil trapping efficiency while limiting the increase in the pressure loss. Further, setting the filling factor of each filter 50 in the range from 0.01 to 0.02 increases the oil trapping efficiency while further limiting the increase in the pressure loss. Particularly, in a case in which the voltage applied between any two adjacent electrode plates 40 is set to 5 kV, setting the filling factor of the filters 50 in the range from 0.01 to 0.02 achieves a high trapping efficiency.

Figure 5:
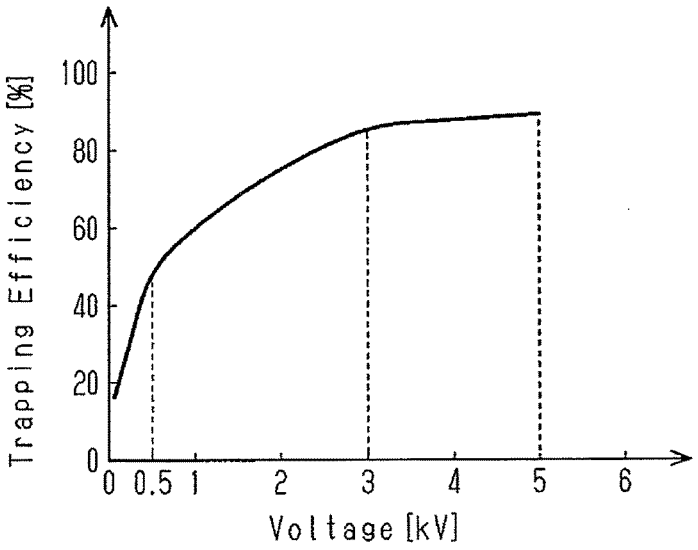
FIG. 5 is a graph showing the relationship between the oil trapping efficiency and the voltage applied between any two adjacent electrode plates.

FIG. 5 is a graph showing the relationship between the oil trapping efficiency and the voltage applied between any two adjacent electrode plates 40. In the experiment for deriving the relationship between the oil trapping efficiency and the voltage applied between any two adjacent electrode plates 40, the voltage applied between any two adjacent electrode plates 40 was changed while maintaining the distance D between the electrode plates 40 at 10 mm, and the oil trapping efficiency was measured. In this experiment, the filling factor of the filters 50 was set to 0.014, the length L of the filters 50 was set to 100 mm, and the cross-sectional area A of the filters 50 was set to 0.0015 $m^2$. The flow velocity of the blow-by gas was set to 1.1 m/s.

As shown in FIG. 5, the higher the voltage applied between any two adjacent electrode plates 40 is, the higher the oil trapping efficiency becomes. However, the rate of increase in the trapping efficiency diminishes when the voltage applied between any two adjacent electrode plates 40 becomes higher than or equal to 3 kV. Thus, setting the voltage applied between any two adjacent electrode plates 40 in the range from 0.5 to 5 kV allows oil to be trapped. Further, setting the voltage applied between any two adjacent electrode plates 40 in the range from 3 to 5 kV achieves a high trapping efficiency while limiting the increase in the power consumption.

Figure 6:
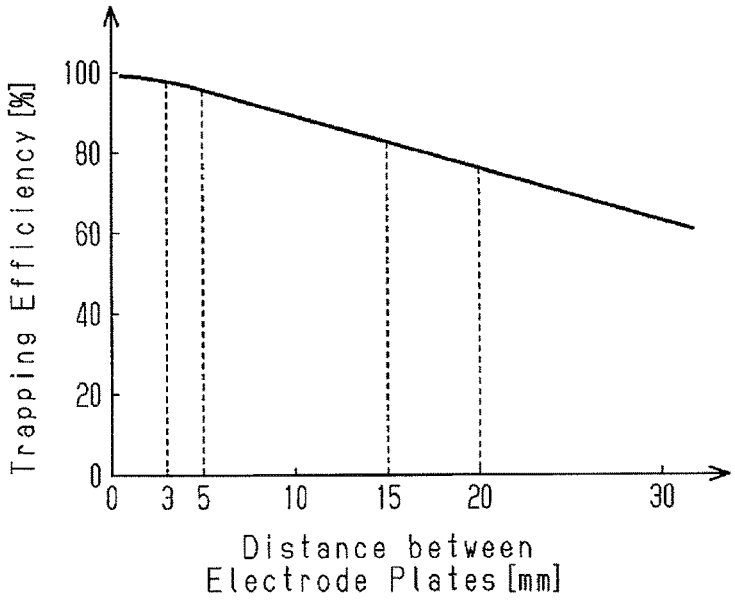
FIG. 6 is a graph showing the relationship between the oil trapping efficiency and the distance between any two adjacent electrode plates.

FIG. 6 is a graph showing the relationship between the oil trapping efficiency and the distance D between any two adjacent electrode plates 40. In the experiment for deriving the relationship between the oil trapping efficiency and the distance D between any two adjacent electrode plates 40, the distance D between any two adjacent electrode plates 40 was changed while maintaining the voltage applied between the electrode plates 40 at 5 kV, and the oil trapping efficiency was measured. In this experiment, the filling factor of the filters 50 was set to 0.014, the length L of the filters 50 was set to 100 mm, and the cross-sectional area of the filters 50 was set to 0.0015 $m^2$. The flow velocity of the blow-by gas was set to 1.1 m/s.

As shown in FIG. 6, the smaller the distance D between any two adjacent electrode plates 40, the higher the oil trapping efficiency becomes. However, if the distance D between any two adjacent electrode plates 40 is excessively small, the two electrode plates 40 will be electrically connected to each other. Thus, setting the distance D between any two adjacent electrode plates 40 in the range from 3 to 20 mm achieves a high trapping efficiency while preventing the two adjacent electrode plates 40 from being electrically connected to each other. Further, setting the distance D between any two adjacent electrode plates 40 in the range from 5 to 15 mm achieves a higher trapping efficiency while preventing the two adjacent electrode plates 40 from being electrically connected to each other.

Figure 7:
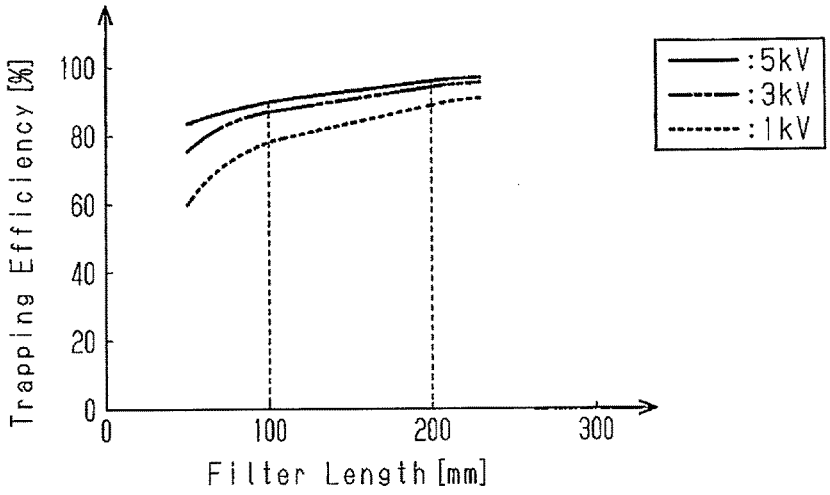
FIG. 7 is a graph showing the relationship between the length of the filters and the oil trapping efficiency.

FIG. 7 is a graph showing the relationship between the oil trapping efficiency and the length L of the filters 50 in the blow-by gas flowing direction. In the experiment for deriving the relationship between the length L of the filters 50 and the oil trapping efficiency, the length L of the filters 50 was changed in each of cases in which the voltage applied between any two adjacent electrode plates 40 was set to 1 kV, 3 kV, and 5 kV, and the oil trapping efficiency was measured in each case. In this experiment, the filling factor of the filters 50 was set to 0.014, the distance D between any two adjacent electrode plates 40 was set to 10 mm, and the cross-sectional area A of each filter 50 was set to 0.0015 $m^2$. The flow velocity of the blow-by gas was set to 1.1 m/s. FIG. 7 shows the relationship between the length L of the filters 50 in the blow-by gas flowing direction and the oil trapping efficiency in each of the cases in which the voltage applied between any two adjacent electrode plates 40 was set to 1 kV, 3 kV, and 5 kV.

As shown in FIG. 7, the longer the length L of the filters 50, the higher the oil trapping efficiency becomes. However, the rate of increase in the trapping efficiency is small in a range of the filter length L greater than or equal to 100 mm. Thus, setting the length L of the filters 50 less than or equal to 200 mm achieves a high oil trapping efficiency while limiting the increase in the size of the oil separator 10. Further, setting the length L of the filters 50 less than or equal to 100 mm makes the oil separator 10 compact while limiting the decrease in the oil trapping efficiency.

Figure 8:
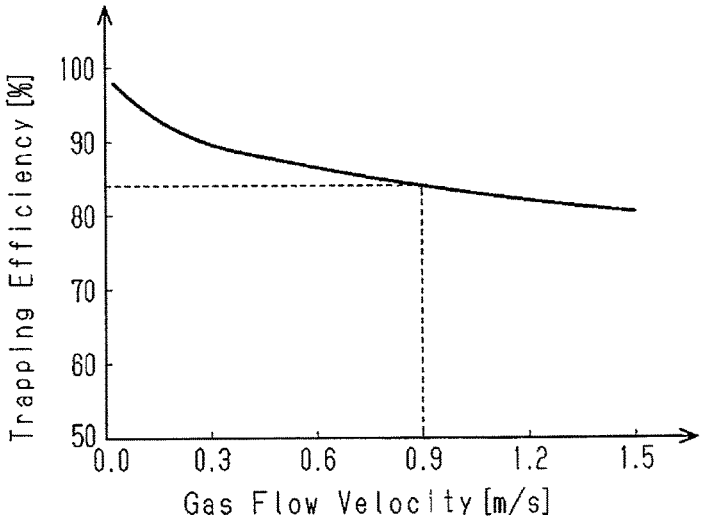
FIG. 8 is a graph showing the relationship between the flow velocity of blow-by gas passing through the filters and the oil trapping efficiency.

FIG. 8 is a graph showing the relationship between the flow velocity of blow-by gas passing through the filters 50 and oil trapping efficiency. In the experiment for deriving the relationship between the flow velocity flowing through the filters 50 and the oil trapping efficiency, the filling factor of the filters 50 was set to 0.014, the voltage applied between any two adjacent electrode plates 40 was set to 5 kV, the distance D between any two adjacent electrode plates 40 was set to 10 mm, and the length L of the filters 50 was set to 100 mm. Then, the oil trapping efficiency was measured while changing the flow velocity of the blow-by gas by changing the cross-sectional area A of the filters 50.

As shown in FIG. 8, the lower the flow velocity of the blow-by gas, the higher the oil trapping efficiency becomes. Setting the cross-sectional area A of each filter 50 perpendicular to the blow-by gas flowing direction to a value at which the flow velocity of blow-by gas passing through the filters 50 is less than or equal to 0.9 m/s achieves an oil trapping efficiency higher than or equal to 84%.

Based on the results of the above described experiments, in the oil separator 10 according to the present embodiment, the filling factor of the filters 50 is set in the range from 0.005 to 0.03, the voltage applied between any two adjacent electrode plates 40 is set in the range from 0.5 to 5 kV, and the distance between any two adjacent electrode plates 40 is set in the range from 3 to 20 mm. Further, the filling factor of the filters 50 is preferably set in the range from 0.01 to 0.02, the voltage applied between any two adjacent electrode plates 40 is preferably set in the range from 3 to 5 kV, and the distance between any two adjacent electrode plates 40 is preferably set in the range from 5 to 15 mm. When the filling factor of the filters 50, the voltage applied between any two adjacent electrode plates 40, and the distance D between any two adjacent electrode plates 40 are set to the above listed values, clogging of the filters 50 is restrained. This also reliably increases the oil trapping efficiency while restricting the two adjacent electrode plates 40 from being electrically connected to each other.

The oil separator according to the above described embodiment has the following advantages.

(1) The filling factor of the filters 50 is set in the range from 0.005 to 0.03, the voltage applied between any two adjacent electrode plates 40 is set in the range from 0.5 to 5 kV, and the distance between any two adjacent electrode plates 40 is set in the range from 3 to 20 mm. Thus, clogging of the filters 50 is restrained. Also, the oil trapping efficiency is reliably increased while any two adjacent electrode plates 40 are prevented from being electrically connected to each other.

(2) Setting the filling factor of the filters 50 in the range from 0.01 to 0.02 increases the oil trapping efficiency while further limiting the increase in the pressure loss.

(3) Setting the length L of the filters 50 less than or equal to 200 mm increases the oil trapping efficiency while limiting the increase in the size of the oil separator 10. Further, setting the length L of the filters 50 less than or equal to 100 mm makes the oil separator 10 compact while limiting the decrease in the oil trapping efficiency.

(4) Setting the cross-sectional area A of each filter 50 perpendicular to the blow-by gas flowing direction to a value at which the flow velocity of blow-by gas passing through the filters 50 is less than or equal to 0.9 m/s achieves an oil trapping efficiency higher than or equal to 84%.

The above described embodiment may be modified as follows.

The length L in the blow-by gas flowing direction of the filters 50 may be longer than 200 mm in accordance with the mounting space for the oil separator 10 in the vehicle.

The cross-sectional area A of each filter 50 perpendicular to the blow-by gas flowing direction does not necessarily need to be set to a value at which the flow velocity of blow-by gas passing through the filters 50 is less than or equal to 0.9 m/s. For example, the cross-sectional area A of each filter 50 perpendicular to the blow-by gas flowing direction may be set to a value at which the flow velocity of blow-by gas passing through the filters 50 is in the range from 0.9 to 1.5 m/s. In this case, an oil trapping efficiency approximately in the range from 80 to 84% is achieved.

The fibers 51, which form the filters 50, do not necessarily need to be made of polyester. For example, the fibers 51 may be made of any of polyethylene, polystyrene, and polytetrafluoroethylene, which have electric resistivity and relative permittivity equivalent to those of polyester. Also, the fibers 51 may be made of, for example, polyamide, acrylic, pulp, or glass.

The fibers 51 forming the filters 50 may be subjected to surface finishing such as water repellent finishing, oil repellent finishing, hydrophilic finishing, lipophilic finishing, in accordance with the intended use.

The filters 50 do not necessarily need to be formed of the plastic fibers 51. The filters 50 may be made of porous polyurethane.

The electrode plates 40 may be made of perforated metal or metal mesh.

The electrode plates 40 may be made of metal other than stainless steel.

At least one of the gas inlet 23 and the gas outlet 24 may be formed in the lid 30.

What is claimed is:

1. An oil separator including a case, wherein the oil separator is configured to introduce blow-by gas of an internal combustion engine into the case, separate oil from the blow-by gas, and discharge the separated oil from the case, the oil separator comprising:

a plurality of electrode plates, which are arranged in the case such that two adjacent electrode plates face each other with a space therebetween;

a filter, which is made of an electrically insulating material and arranged between the adjacent electrode plates, configured to trap the oil from the blow-by gas being introduced into and discharged from the case; and a power supply unit, which is connected to the electrode plates and applies voltage between the adjacent electrode plates, thereby creating a potential difference between the adjacent electrode plates, wherein a filling factor of the filter is in a range from 0.005 to 0.03, the voltage applied between the adjacent electrode plates by the power supply unit is in a range from 0.5 to 5 kV, and a distance between the adjacent electrode plates is in a range from 3 to 20 mm.

2. The oil separator according to claim 1, wherein the filling factor of the filter is in a range from 0.01 to 0.02.

3. An oil separator including a case, wherein the oil separator is configured to introduce blow-by gas of an internal combustion engine into the case in a blow-by gas flow direction, separate oil from the blow-by gas, and discharge the separated oil from the case, the oil separator comprising:

a plurality of electrode plates, which are arranged in the case such that two adjacent electrode plates face each other with a space therebetween;

a filter, which is made of an electrically insulating material and arranged between the adjacent electrode plates, configured to trap the oil from the blow-by gas being introduced into and discharged from the case; and a power supply unit, which is connected to the electrode plates and applies voltage between the adjacent electrode plates, thereby creating a potential difference between the adjacent electrode plates, wherein a filling factor of the filter is in a range from 0.005 to 0.03, the voltage applied between the adjacent electrode plates by the power supply unit is in a range from 0.5 to 5 kV, a distance between the adjacent electrode plates is in a range from 3 to 20 mm, and the plurality of electrode plates extend in a vertical direction of the case that is orthogonal to the blow-by gas flow direction and in a longitudinal direction of the case that corresponds to the blow-by gas flow direction such that when blow-by gas is introduced into the case, the blow-by gas flows along the longitudinal direction of the plurality of electrode plates in the space between the adjacent electrode plates.

4. The oil separator according to claim 3, wherein the filling factor of the filter is in a range from 0.01 to 0.02.

* * * * *